United States Patent [19]

Fahl

[11] Patent Number: 4,784,795

[45] Date of Patent: Nov. 15, 1988

[54] LUBRICANT COMPOSITION FOR WATER FITTINGS

[75] Inventor: Ulrich W. Fahl, Munich, Fed. Rep. of Germany

[73] Assignee: Dow Corning GmbH, Munich, Fed. Rep. of Germany

[21] Appl. No.: 814,142

[22] Filed: Dec. 27, 1985

[30] Foreign Application Priority Data

Dec. 24, 1984 [DE] Fed. Rep. of Germany ..... 3447346

[51] Int. Cl.[4] ..... C10M 137/00; C10M 129/34

[52] U.S. Cl. ..... 252/32.5; 252/33.6; 252/49.6; 252/51.5 A

[58] Field of Search ..... 252/33.6, 51.5 A, 32.7 E, 252/49.6, 32.5

[56] References Cited

U.S. PATENT DOCUMENTS

| | | | |
|---|---|---|---|
| 2,352,164 | 6/1944 | Burnham et al. | 252/47.5 |
| 2,830,019 | 4/1958 | Fields et al. | 252/51.5 A |
| 2,959,547 | 11/1960 | Brillhart | 252/33.6 |
| 3,240,701 | 3/1966 | Furia | 252/33.6 |
| 3,265,620 | 8/1966 | Heiman | 252/33.6 |
| 3,408,843 | 11/1968 | Treat | 252/33.6 |
| 3,860,521 | 1/1975 | Aepli et al. | 252/33.6 |
| 4,537,694 | 8/1985 | Horodysky | 252/33.6 |

*Primary Examiner*—Jacqueline V. Howard
*Attorney, Agent, or Firm*—George A. Grindahl

[57] ABSTRACT

A lubricant for water fittings is described which essentially consists of a natural or synthetic high viscosity lubricating oil or lubricating grease, possibly an organic or inorganic thickener, and an additive in the form of at least one complexing agent and possibly at least one hydrophobing agent. Compared to known lubricants for water fittings, said lubricant is characterized by a performance capability which lasts substantially longer since the formation of disturbing deposits, particularly in the form of lime and rust, is greatly inhibited with said lubricant. The water fittings lubricated with this lubricant therefore remain functional substantially longer.

5 Claims, No Drawings

LUBRICANT COMPOSITION FOR WATER FITTINGS

BACKGROUND OF THE INVENTION

Moving parts in the water supply sector, namely, so-called water fittings such as are represented, for example, by water faucets, water pumps, water level monitors, water sliding valves and other water shut-off devices or also thermostat valves in the household or in industry and which, for example, are made of a metal such as brass or also of ceramics such as aluminum oxide ceramics, must be treated with special lubricants in order to maintain their function, namely, their movability, and, at the same time, maintain the watertightness of their sliding surfaces.

A wide variety of lubricants are already available for this purpose. These lubricants essentially consist of a natural or synthetic high viscosity lubricant component such as a lubricating oil or lubricating grease which usually contains a thickener to increase its consistency further.

Examples of such lubricants are the fittings and damping greases of Klueber Lubrication Munich KG, Munich, sold under the name UNISILIKON L. They consist of high viscosity dimethylsiloxane as the lubricating oil and finely divided polytetrafluoroethylene as the thickener. UNISILIKON L 641 contains 67 weight percent dimethyl polysiloxane with a viscosity of 50,000 $mm^2 . sec^{-1}$ and 33 weight percent polytetrafluoroethylene powder with a melting point of approximately 330° C., a melt viscosity at 380° C. of approximately $10^3$ Pa.sec, a density of approximately 2.2 and an average particle size of approximately 1 to 3 μm. With regard to these UNISILIKON L silicone greases, refer, for example, to pages 6 and 7 of the product pamphlet of the Klueber Company with the designation 02-11-2d.

Another lubricant of this type is DOW CORNING FS-3452 sealing grease which contains a high viscosity fluorosilicone oil as the lubricant and polytetrafluoroethylene as the thickener and, for example, is described in product pamphlet 71-114-03 from Dow Corning GmbH, Munich.

Water-fitting lubricants based on high viscosity dimethylpolysiloxanes, and thickened with highly disperse silicon dioxide, are also already available such as, for example, MOLYKOTE 111 COMPOUND and DOW CORNING VALVE SEAL, which, for example, are described in product pamphlets 22-063B-03 and 22-208-03 from Dow Corning GmbH, Munich.

Also known are comparable water-fitting lubricants based on natural high viscosity lubricating oils, again mixed with the usual organic or inorganic thickeners to increase their consistency. Such lubricants are, for example, the fittings greases and faucet greases, MOLYKOTE 1011 and 1001, which contain a paraffin oil as the lubricating oil (paraffinum subliquidum 210-extra heavy) and bentonite as the thickener and, for example, as described in product pamphlet 71-119-03 from Dow Corning GmbH, Munich.

Unfortunately, the known lubricants for water fittings, such as water faucets and so forth, have the disadvantage that their effectiveness is increasingly impaired with the passage of time since quite diverse deposits form on the surfaces to be lubricated, particularly deposits of lime and rust. In this way, the functioning of the individual fittings is very substantially shortened and there is a premature failure due to leakage and wear.

BRIEF SUMMARY OF THE INVENTION

The goal of the invention is therefore the creation of a new lubricant composition for water fittings, such as water faucets and so forth, which will retain its effectiveness substantially longer, compared to known lubricants, because the formation of deposits, particularly deposits in the form of lime and rust, on the contact surfaces of the lubricated moveable parts of such fittings is substantially inhibited so that such fittings have a substantially longer functionability.

This goal is attained in accordance with the invention by the water-fitting lubricant residing in the patent claims, which is essentially distinguished from known lubricants of this type by containing (a) a lubricant component and, as an additive, (b) at least one complexing agent and, optionally, (c) at least one hydrophobing agent.

Compared to known water-fitting lubricants with a comparable lubrication performance, the lubricant in accordance with the invention is characterized above all by the substantially longer retention of its lubricating character since the disturbing formation of deposits, particularly in the form of lime and rust, is blocked for a long period of time by this lubricant. Fittings treated with said lubricant therefore remain functional for a relatively long period of time.

The lubricant in accordance with the invention is, of course, preferably designed in terms of its different constitutve components in such a way that it fulfills the relevant legal regulations for foods since it should be used primarily for water fittings, such as water faucets and so forth. Therefore, with regard to its composition all components which do not satisfy this condition are normally eliminated as possibilities.

The present invention relates to a lubricant composition comprising (a) a lubricant component and (b) an ion-removing amount of an additive component selected from the group consisting of complexing agents. The performance of the lubricant composition can be further enhanced by the inclusion therein of an effective amount of a hydrophobing agent.

The major component of the lubricant composition in accordance with the invention is, of course, a lubricant component (a) which can be a natural or synthetic high viscosity lubricating oil or lubricating grease used in known lubricants of this type, and comprising approximately 55 to 95 weight percent and preferably approximately 65 to 85 weight percent and particularly approximately 70 to 80 weight percent of the total lubricant. Of course, the fraction of lubricating oil or lubricating grease will be higher for a lower fraction of organic or inorganic thickener which may be present so that the indicated upper limit values are primarily valid when such a lubricant contains no thickener at all or only a small amount of thickener. Also, the amount of any hydrophobing agent present will, of course, influence the amount of lubricating oil or lubricating grease in the lubricant according to the invention.

Lubricating oils or lubricating greases which are suitable in accordance with the invention are, for example, high viscosity mineral oils, synthetic hydrocarbons, aliphatic or aromatic polyethers, fluorinated polyethers, silicones or fluorinated silicones. The viscosity of such lubricating oils or lubricating greases generally lies between approximately 40,000 and 150,000 $mm^2 . sec^{-1}$ at 25° C. Dimethylpolysiloxane with viscosiies in this range are particularly preferred. However, lubricating oils or lubricating greases based on mineral oil can also be used instead, namely, for example, white oils or lubricating greases based on mineral oil can also be used instead, namely, for example, white oils with a viscosity lying in this range such as medium-heavy, heavy and extra-heavy paraffin oils.

Depending on the viscosity of the lubricating oil or lubricating grease present in the lubricant in accordance with the invention or on other properties which may be desired, such as increased adhesion and wash-out resistance, the lubricant in accordance with the invention either contains no thickener at all or a certain amount of a customary organic or inorganic thickener. The amount of thickener present can therefore reach up to approximately 40 to 45 weight percent and it preferably comprises approximately 5 to 25 weight percent of the total composition. The type of thickener to be used is known to the expert and among these are, for example, organic thickeners such as metal soaps, metal complex soaps, polyureas, terephthalamates, plastic powders of widely varying types such as polyamide powder, polytetrafluoroethylene powder or polyfluoroethylene-propylene powder or inorganic thickeners such as highly disperse silicon dioxides, bentonites, montmorillonites, hectorites and metal oxides.

The component which is primarily responsible for the special mode of action of the lubricant in accordance with the invention is additive (b), at least one complexing agent. This component ensures that ions which would otherwise lead to deposits do not produce any precipitations since the ions are bonded in complexes. In the invention, a complexing agent is preferably used which is relatively hard to dissolve in water so it will be consumed only slowly as time passes and thus will produce a lasting effect. In particular, a complexing agent is used which is primarily capable of binding or the exchange of calcium ions and iron ions. Mixtures of different types of complexing agents can be used.

The amount of complexing agent in the lubricant of the invention is generally 0.3 to 3 weight percent and it preferably comprises 0.5 to 1.5 weight percent. In principle and in accordance with the invention, all complexing agents are suitable which form water-soluble complexes of those ions which cause disturbances primarily through a risk of precipitation, namely, mainly water-soluble complexes of calcium ions and iron ions. Complexing agents or also chelating agents suitable for this purpose are known to the expert. Particularly suitable complexing agents in accordance with the invention are, for example, ethylenediaminetetraacetic acid, nitriloacetic acid, trans-1,2-cyclohexylenedinitrilotetraacetic acid, diethylenetriaminopentaacetic acid, polyphosphoric acid, oxyethylenediaminetriacetic acid, bis(2-aminoethyl)glycol ether-N,N,N',N'-tetraacetic acid or aminopolycarboxylic acids or salts of these acids—preferably the alkali metal salts such as the sodium salts or potassium salts.

The use, in accordance with the invention, of additive (b), that is, a complexing agent ensures in particular that the pertinent lubricant is more resistant to the formation of deposits, such as deposits of lime or iron oxide, with the result that a substantial improvement in this effect is attained in comparison to the known lubricants. However, lubricants for water fittings, such as water faucets and so forth, are also exposed to the danger of emulsification by water so that a certain protection in this regard would be advantageous. Such a protection is attained in accordance with the invention by a hydrophobing agent (c). Such a hydrophobing agent is not necessarily present in the lubricant of the invention; however, its presence will normally produce a further improvement in the performance of said lubricant.

The quantity of hydrophobing agent (c) is accordingly generally 0 to 15 weight percent and preferably 3 to 10 weight percent—again with reference to the total weight of the individual components present in the lubricant of the invention.

Again, in principle all substances are suitable here which are known to produce a reinforcement of the hydrophobic properties of the lubricants under discussion. However, as a function of the type of natural or synthetic high viscosity lubricating oil or lubricating grease present in the lubricant of the invention, different types of hydrophobing agents are appropriately used. Thus, for silicone-based synthetic lubricating oils or lubricating greases, silicone-based hydrophobing agents must also be primarily used. Examples of such hydrophobing agents are dimethylsilicone gums, methylphenylsilicone gums, methylsilicone resins, methylphenylsilicone resins, silicone alkyd resins, the condensation products of polysiloxanes and polyesters or polyepoxides, polysiloxane resins with vinyl groups or allyl groups or siloxane-silazane copolymers.

When the lubricating oils or lubricating greases present in the lubricant of the invention are not based on silicone and thus represent the corresponding natural or synthetic lubricating oils or lubricating greases such as mineral oils, synthetic hydrocarbons or aliphatic or aromatic polyethers or fluorinated polyethers, the hydrophobing agent (c) is preferably a tall oil resin or an alkyd resin.

The lubricants of the invention are prepared by the usual methods in lubricant technology by, for example, first mixing the pertinent lubricating oil or lubricating grease with any organic or inorganic thickener to be used and then mixing into the resulting mixture the additives in accordance with the invention, that is, the complexing agents (b) and possibly the hydrophobing agent (c). However, any other sequence of mixing of the individual components with one another can be used so that, for example, all the components can also be mixed with one another at the same time and processed to give a lubricant of the invention.

As already mentioned, the lubricant of the invention is suitable for use, most importantly, as a lubricant for water fittings, such as water faucets and so forth, and is preferred for the corresponding fittings made of ceramics such as, for example, of aluminum oxide ceramics. In addition to the desired high lubricating effect and watertightness, most importantly it then imparts to fittings treated with it a particularly long service life without premature loss of their functionability.

The invention is further explained in the following with the aid of examples.

In the following examples, polytetrafluoroethylene and polyfluoroethylene-propylene are used, among others, as thickeners while white oil is also used, among others, as a lubricating oil in addition to the indicated dimethylpolysiloxanes. These are the following products with the following physical properties indicated at least in part and the cited reference:

(a) Polytetrafluoroethylene

HOSTAFLON TF 9202 from Hoechst AG, Frankfurt, is used throughout as the polytetrafluoroethylene. It is described in said company's technical bulletin. Accordingly, the essential properties of this polytetrafluoroethylene are a melting point of approximately 330° C., a melt viscosity at 380° C. of approximately $10^3$Pa.sec, a density of approximately 2.2 and an average particle size of approximately 3 to 6 μm. However, in place of this thickener, other thickeners can also be used with comparable success such as, for example, the thickeners HOSTAFLON TF 9205 or TF VP 9203 from the same producer.

(b) Polyfluoroethylene-propylene

The product designated by TL-120 from the LNP Corporation, Pennsylvania, U.S.A., is used as the polyfluoroethylenepropylene. It is described in the company's technical bulletin designated by P.D. 601-4-880. The essential properties of this polyfluoroethylene-propylene are a density of approximately 2.12 to 2.18, an average particle size of 1 to 2 μm and a surface of 10 $m^2/g$. Instead of this polyfluoroethylenepropylene, of course, other polyfluoroethylene-propylenes can also be used as organic thickeners.

(c) White Oil

Paraffinum subliquidum 210 (extra heavy) from the Texaco Company is used as the white oil and is described in Texaco's technical bulletin. This is an oil which is free of aromatic substances and unsaturated hydrocarbons and which satisfies the regulation DAB VII (German Pharmacopoeia). Of course, other white oils can also be used instead of this.

EXAMPLE 1

79 weight percent dimethylpolysiloxane with a viscosity at 25° C. of 50,000 $mm^2.sec^{-1}$, 20 weight percent polytetrafluoroethylene (HOSTAFLON TF 9202) and 1% nitrilotriacetic acid are mixed in a homogenizer. The lubricant thus obtained appears milky white and is suitable, above all, for the lubrication and sealing of water fittings and, in particular, ceramic fittings.

EXAMPLE 2

69 weight percent dimethylpolysiloxane with a viscosity at 25° C. of 100,000 $mm^2.sec^{-1}$ and 20 weight percent polytetrafluoroethylene of the type indicated above are mixed in a homogenizer and 10 weight percent dimethyltrimethylpolysiloxane with a viscosity at 25° C. of 600 to 1000 $mm^2.sec^{-1}$ and 1 weight percent trans-1,2-cyclohexylenedinitrilotetraacetic acid are then added with further mixing. A lubricant with a milky white appearance is obtained.

EXAMPLE 3

60 weight percent dimethylpolysiloxane with a viscosity at 25° C. of 60,000 $mm^2.sec^{-1}$ and 20 weight percent polyfluoroethylene-propylene (TL 120) are mixed in a homogenizer and then, with further thorough mixing, 10 weight percent methylphenylpolysiloxane with a viscosity at 25° C. of 5000 $mm^2.sec^{-1}$ and 10 weight percent vinylbenzyltrimethylammonium polymer are added. A milky white lubricant is obtained.

EXAMPLE 4

69 weight percent dimethylpolysiloxane with a viscosity at 25° C. of 60,000 $mm^2.sec^{-1}$ are mixed in a homogenizer with 20 weight percent polytetrafluoroethylene and this is then mixed, with thorough mixing, with 10 weight percent dimethyltrimethylpolysiloxane with a viscosity at 25° C. of 600 to 1000 $mm^2.sec^{-1}$ and 1 weight percent ethylenediaminetetraacetic acid. The milky white lubricant obtained in this manner exhibits an unworked penetration in decimillimeters (50 g cone) of 330 to 350, a water resistance according to DIN 51807 at 5 h/90° C. of 0 and a dynamic viscosity at 200 $sec^{-1}$ of 33,000 $mm^2.sec^{-1}$ (20° C.), 29,000 $mm^2.sec^{-1}$ (40° C.) and 25,000 $mm^2.sec^{-1}$ (60° C.) The theoretical temperature range of this lubricant extends from −40° C. to +200° C.

EXAMPLE 5

79 weight percent dimethylpolysiloxane with a viscosity at 25° C. of 60,000 $mm^2.sec^{-1}$ and 20 weight percent polytetrafluoroethylene are mixed with one another in a homogenizer and the obtained mixture is then thoroughly mixed with 1 weight percent ethylenediaminetetraacetic acid to obtain a lubricant with a milky white appearance.

EXAMPLE 6

83 weight percent white oil (paraffinum subliquidum 210) is mixed in a homogenizer with 10 weight percent aluminum stearate benzoate complex and then, with further thorough mixing, 5 weight percent tall oil resin (40%) and 2 weight percent nitrilotriacetic acid are added. A somewhat yellowish lubricant is obtained.

EXAMPLE 7

(Comparison)

67 weight percent dimethylpolysiloxane with a viscosity at 25° C. of 50,000 $mm^2.sec^{-1}$ is mixed in a homogenizer with 33 weight percent polytetrafluoroethylene to obtain a conventional fittings and damping grease. It corresponds to the silicone grease from Klueber Lubrication Munich KG known under the tradename, UNISILIKON L 641.

COMPARISON EXPERIMENTS

In these comparison experiments, Karibik 2000 water fittings from the Rokal Company are used in which two perforated ceramic disks control the water throughflow and mixing temperature. The lubricant under investigation is applied by the so-called rolling-on technique on the clean surfaces of the ceramic disks to be lubricated and is then subjected to the following test cycle: water temperature=80° C., mixing operation=15° C., closing and opening to alternating settings by asynchronous drives. The test stand operates with 19 radial and 21 axial cycles per minute. The water fittings used are described in the Rokal Company's technical bulletin.

Under identical conditions, the lubricants resulting from the following formulations are subjected to a performance comparison in the Karibik 2000 household water fittings from the Rokal Company and the following results are obtained:

| Lubricant | Cycles in Test Stand |
|---|---|
| Example 4 | above $2 \times 10^5$ |

-continued

| Lubricant | Cycles in Test Stand |
|---|---|
| Example 5 | $4 \times 10^5$ |
| Example 7 (Comparison) | below $10^5$ |

The above experimental data demonstrate that the lubricant of the invention (Example 4=containing lubricating oil+thickener+complexing agent, Example 5=containing lubricating oil+thickener+complexing agent+hydrophobing agent), compared to a known lubricant (Example 7=containing lubricating oil+-thickener), produces a substantially higher performance since it can withstand substantially more cycles in the test stand with the water fittings mentioned.

That which is claimed is:

1. A lubricant composition for water fittings consisting essentially of (a) a lubricant component having a viscosity of from 40,000 to 150,000 $mm^2$/sec and (b) an ion-removing amount of an additive component selected from the group consisting of complexing agents and (c) a hydrophobing agent.

2. A lubricant composition according to claim 1 wherein the additive component is capable of removing calcium ions and iron ions.

3. A lubricant composition according to claim 2 wherein the additive component comprises from 0.3 to 3 percent by weight of the lubricant composition and is a complexing agent selected from the group consisting of ethylenediaminetetraacetic acid, nitriloacetic acid, trans-1,2-cyclohexylenedinitrilotetraacetic acid, diethylenetriaminepentaacetic acid, polyphosphoric acid, oxyethylenediaminetriacetic acid, bis(2-aminoethyl)-glycolether-N,N,N',N'-tetraacetic acid and an aminopolycarboxylic acid and salts of said acids.

4. A lubricant composition according to claim 3 wherein the lubricant component comprises a synthetic silicone-based lubricating oil or grease and the hydrophobing agent is selected from the group consisting of dimethylsilicone gum, methylphenylsilicone gum, methylsilicone resin, methylphenylsilicone resin, silicone alkyd resin, the condensation product of a polysiloxane and a polyester or polyepoxide, polysiloxane resin with vinyl groups or allyl groups or a siloxane-silazane copolymer.

5. A lubricant composition according to claim 3 wherein the lubricant component comprises a natural or synthetic lubricating oil or grease and the hydrophobing agent is selected from the group consisting of tall oil and alkyd resin.

* * * * *